US008082635B2

(12) United States Patent
Leveau

(10) Patent No.: US 8,082,635 B2
(45) Date of Patent: Dec. 27, 2011

(54) SLIDER

(76) Inventor: Jens Leveau, Visby (SE)

( * ) Notice: Subject to any disclaimer, the term of this patent is extended or adjusted under 35 U.S.C. 154(b) by 406 days.

(21) Appl. No.: 12/446,705

(22) PCT Filed: Oct. 31, 2007

(86) PCT No.: PCT/SE2007/050797

§ 371 (c)(1),
(2), (4) Date: Jul. 10, 2009

(87) PCT Pub. No.: WO2008/054317

PCT Pub. Date: May 8, 2008

(65) Prior Publication Data

US 2010/0287742 A1 Nov. 18, 2010

(30) Foreign Application Priority Data

Nov. 1, 2006 (SE) ..... 0602297

(51) Int. Cl.
*A44B 19/24* (2006.01)
*A44B 19/28* (2006.01)

(52) U.S. Cl. ..... 24/416; 24/418; 24/429; 24/419; 24/420

(58) Field of Classification Search ..... None
See application file for complete search history.

(56) References Cited

U.S. PATENT DOCUMENTS 2,020,159 A * 11/1935 Pruzan ..... 24/416
2,495,176 A * 1/1950 Nissen ..... 24/416
2,721,366 A * 10/1955 Deshaw ..... 24/416
2,764,794 A * 10/1956 Meech et al. ..... 24/416
2,779,988 A * 2/1957 Simpson ..... 24/416
2,782,481 A * 2/1957 Mercer ..... 24/416
2,785,452 A * 3/1957 Garsson ..... 24/417
2,786,250 A * 3/1957 Garsson ..... 24/417
2,788,557 A * 4/1957 Garsson ..... 24/416
2,790,224 A * 4/1957 Mercer ..... 24/416
2,792,611 A * 5/1957 Morin ..... 24/416

FOREIGN PATENT DOCUMENTS

GB 771 473 4/1957
GB 772 437 4/1957

* cited by examiner

*Primary Examiner* — Jack W. Lavinder
(74) *Attorney, Agent, or Firm* — Young & Thompson

(57) ABSTRACT

A slider for a zip fastener includes a lower part, an upper part and a puller. The lower part and upper part are interconnected by a hinge, whereby the slider can be set in an open and a closed condition, respectively. The puller, which is made of a resilient material and constitutes the part that the user holds when using the slider, includes locking pins for locking the lower part and upper part in the closed condition, and also dividing shoulders. The lower part includes a hole which can receive the locking pins of the puller in order to lock the lower part and the upper part in the closed condition. The upper part includes a cradle for the locking pins of the puller and also a slanted dividing body, which is capable of separating the dividing shoulders and therewith the locking pins of the puller. Further, the upper part includes two hinge taps and the lower part includes an area for cooperation with the hinge taps.

5 Claims, 8 Drawing Sheets

SLIDER

TECHNICAL FIELD

The invention pertains to a slider for a zip fastener, and to a method for assembling such a slider.

BACKGROUND

The present slider has been developed for facilitating simple zip fastener repair. What previously was thrown away due to a defect slider, can by means of the present slider be used again. The slider can be mounted on an ordinary zip fastener and the slider can thereby replace defect sliders on zip fasteners. The removal of the slider is equally simple as the mounting.

GB771473 A discloses a slider of the type mentioned above. In conformity with the present invention, the slider of GB771473 A comprises an upper part 20, a lower part 10 and a puller 40. The upper part and the lower part are connected by means of a hinge. The hinge is comprised of a fastening pin extending through holes in the upper part and the lower part, respectively. A problem relating to this prior art slider is its relatively time consuming, complex and hence costly assembly. Upon formation of the hinge, the respective holes must be aligned before the fastening pin can be introduced through the holes. Subsequently, the fastening pin must be headed in order not to fall out of the holes.

According to GB772437 A, the upper part 20 and the lower part 10 of a slider are connected by a hinge. The hinge can be comprised of two hinge taps 36 protruding from the upper part, which hinge taps 36 cooperate with an aperture 16 of the lower part. In accordance with a preferred embodiment of GB772437 A, these hinge taps 36 are to be formed and introduced into the aperture 16 by means of a pair of die punches 30 (FIG. 6). This additional joining step must be performed after the upper part has been mounted onto the lower part. However, GB772437 A also suggests accomplishing the hinge by forming the hinge taps 36 on the upper part before this is mounted together with the lower part. Then, the joining is made by snapping the hinge taps 36 of the upper part over the lower part. The hinge can further, according to GB772437 A, be formed in a manner wherein the hinge taps 36 are replaced by apertures. A fastening pin is inserted through said apertures and through the aperture 16 of the lower part, whereupon the fastening pin is headed (compare GB771473 A).

The object of the present invention is to provide a slider that can repair defect zip fastener in a simple operation. The components of the slider should be easy to assemble. Further, the components should be designed in a manner ensuring rigid slider construction and long life.

SUMMARY OF THE INVENTION

The objects have been achieved by the slider in accordance with the invention, especially by means of the mounting presenting a unique assembly, the design of the different hinges of the slider and their appearance, and also the solution that results in simple operation.

The slider comprises a lower part, an upper part and a puller. The lower part and the upper part are interconnected by means of a hinge, whereby the slider can be set in an open and a closed condition, respectively. The puller, which is made of a resilient material and constitutes the part that the user holds when using the slider, comprises locking pins for locking the upper part and the lower part in the closed condition, and also dividing shoulders. The lower part, which when the slider is mounted to a zip fastener mainly is located on a first side of the zip fastener, comprises a hole which can receive the locking pins of the puller in order to lock the lower part and the upper part in the closed condition. The upper part, which when the slider is mounted to a zip fastener mainly is located on a second side of the zip fastener, comprises a cradle for the locking pins of the puller and also a slanted dividing body, which is capable of separating the dividing shoulders and therewith the locking pins of the puller. Further, the upper part comprises two hinge taps and the lower part comprises an area for cooperation with said hinge taps. The hinge between the lower part and the upper part is formed through cooperation between the hinge taps and the area. The area of the lower part comprises an assembly chamfer, which by cooperating with the hinge taps is adapted to pivotally lock the upper part and the lower part. The area of the lower part also comprises a guiding groove, in which the hinge taps are led upon assembly of the upper part to the lower part, whereby the assembly chamfer forces the hinge taps outwards in a slight resilient movement.

The invention further pertains to a method for assembly of the above described slider. According to the method, the upper part is mounted to the lower part by pressing the upper part onto the lower part straight from above, whereby the hinge taps of the upper part and the lower parts' area for cooperation with said hinge taps interconnect the parts.

By designing the hinge in accordance with the invention a simple assembly procedure is obtained. Further, a slider of few moving parts, being of rigid construction is provided. This gives a slider of long life and relatively low costs of production.

DESCRIPTION OF AN EMBODIMENT

Figure 1:
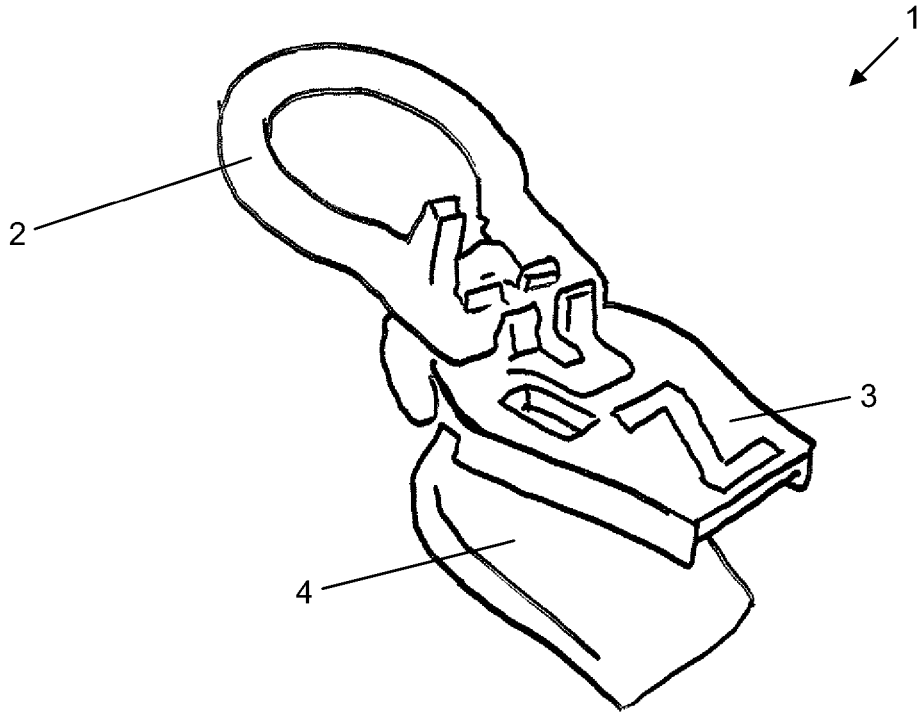
FIG. 1 shows the slider in accordance with the invention with puller, upper part and lower part.

Here, the three component parts needed for rendering the slider openable are described. Progress has also been made for facilitating assembly of the slider during manufacture.

This is also described and constitutes an important aspect of this compilation. The compilation also depicts slider measurements in the drawings, these measurements are in other respects to be individually adapted in accordance with different types of zip fasteners. The solution manages an average usage of the zip fastener of 45 000 cycles.

Figure 2:
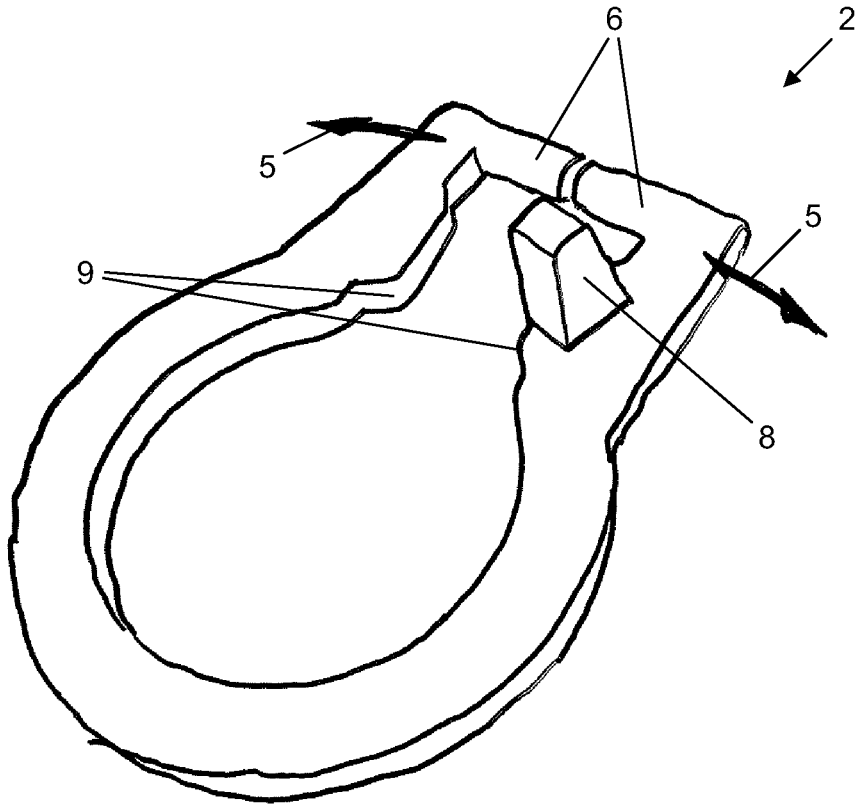
FIG. 2 shows the underside of the puller with locking pins, lock tap and dividing shoulders, and also illustrates the resilient movement of the puller.
Figure 3:
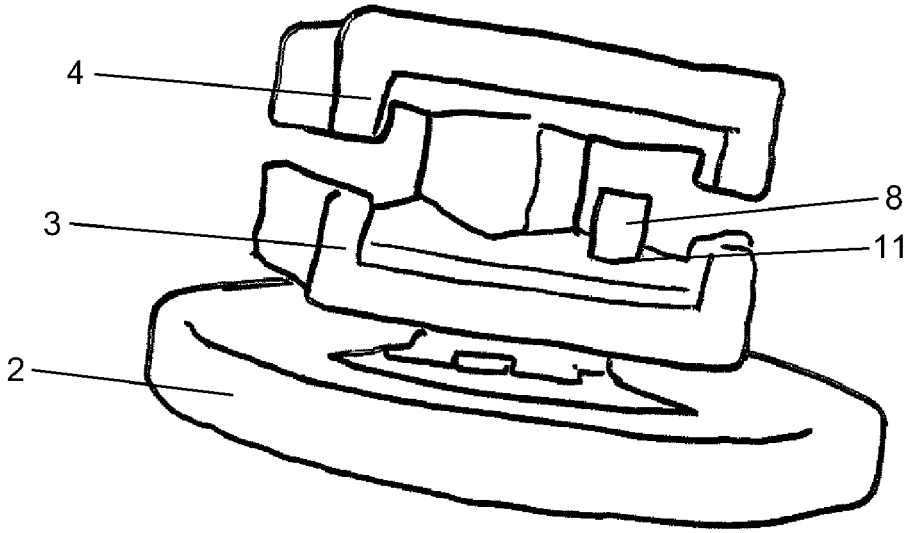
FIG. 3 illustrates the functions of the lock tap by a view through the slider.
Figure 9:
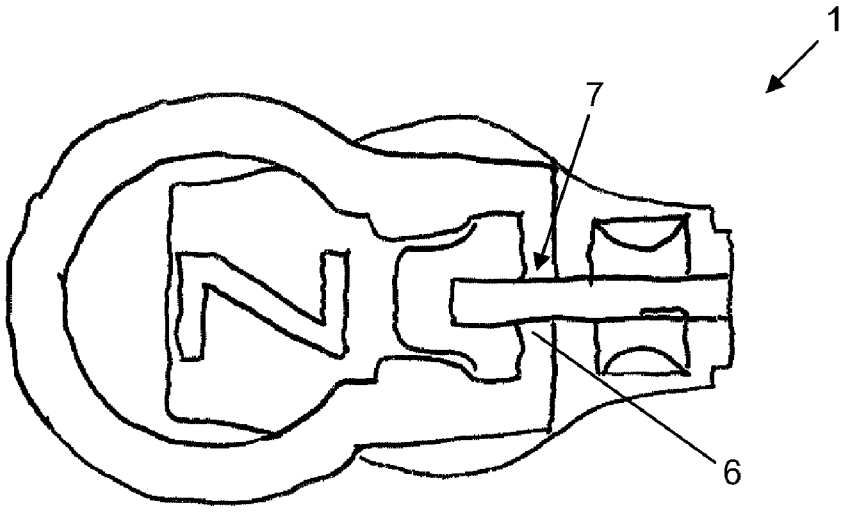
FIG. 9 shows the slider in closed condition with the locking pins positioned in the through hole of the lower part and in the cradle of the upper part.
Figure 9:
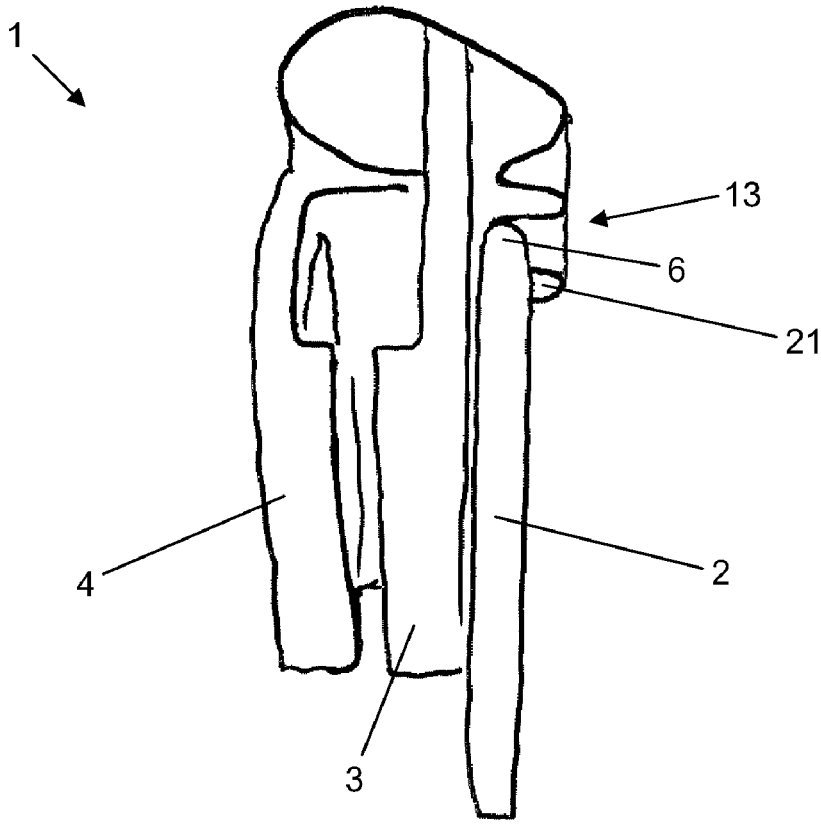
Figure 10:
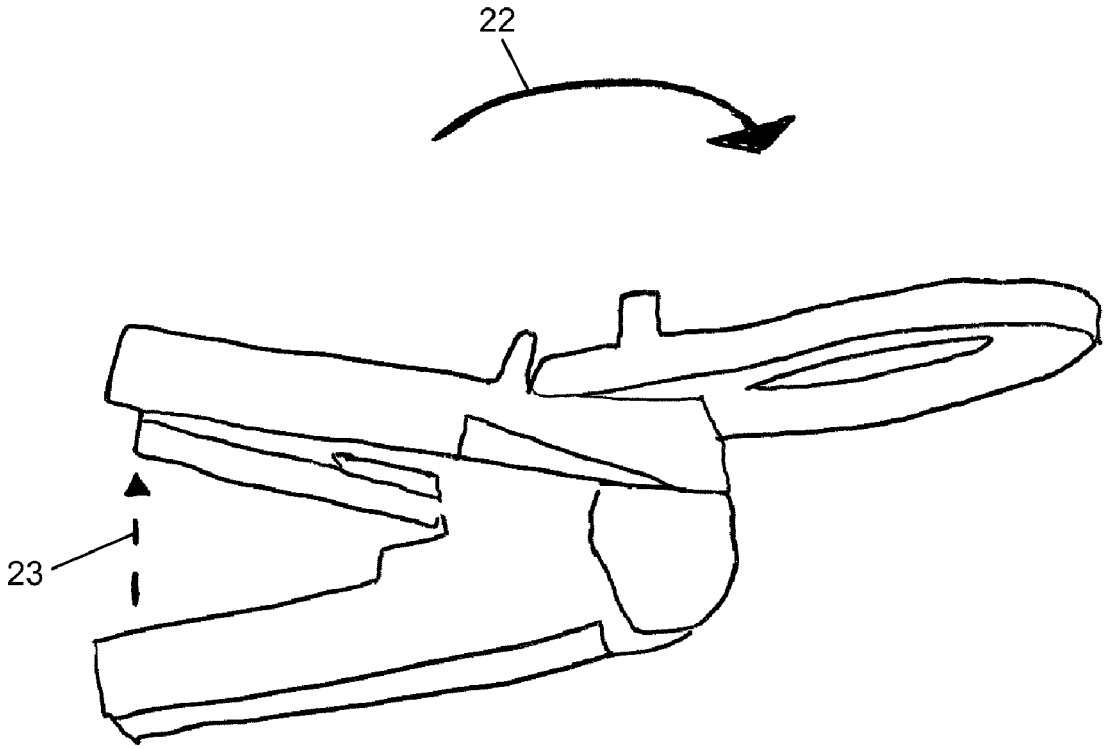
FIG. 10 illustrates the opening of the slider.

FIG. 1 shows the slider 1 and its components; the puller 2, upper part 3 and lower part 4. FIG. 2 shows the underside of the puller. The puller can be manufactured from a resilient steel material or plastic. The resilient movement of the puller is illustrated by two arrows 5 in FIG. 2. Besides being the part that the user holds when the slider is used, the puller has additional functions as described. The locking pins 6 are hooked in through hole 7 on the lower part and thereby lock the slider. Then, the slider cannot de disengaged from the zip fastener (FIG. 9). The lock tap 8 provides the possibility to lock the slider with respect to the zip fastener (FIG. 3). As the puller and its dividing shoulders 9 are pressed in a direction backwards onto the slanted dividing bodies 10 of the upper part, the dividing shoulders 9 are forced outwards. The locking pins 6 follow the same movement and thus disengage the through hole 7, whereby the slider can be opened (FIG. 10).

FIG. 3 illustrates the function of the lock tap 8 by a view through the slider. When the puller 2 is folded down towards the upper part 3, the lock tap 8 passes through the clearance 11 of the upper part 3 and locates itself between two teeth of the zip fastener. Now, the slider is locked and cannot be moved along the zip fastener.

Figure 4:
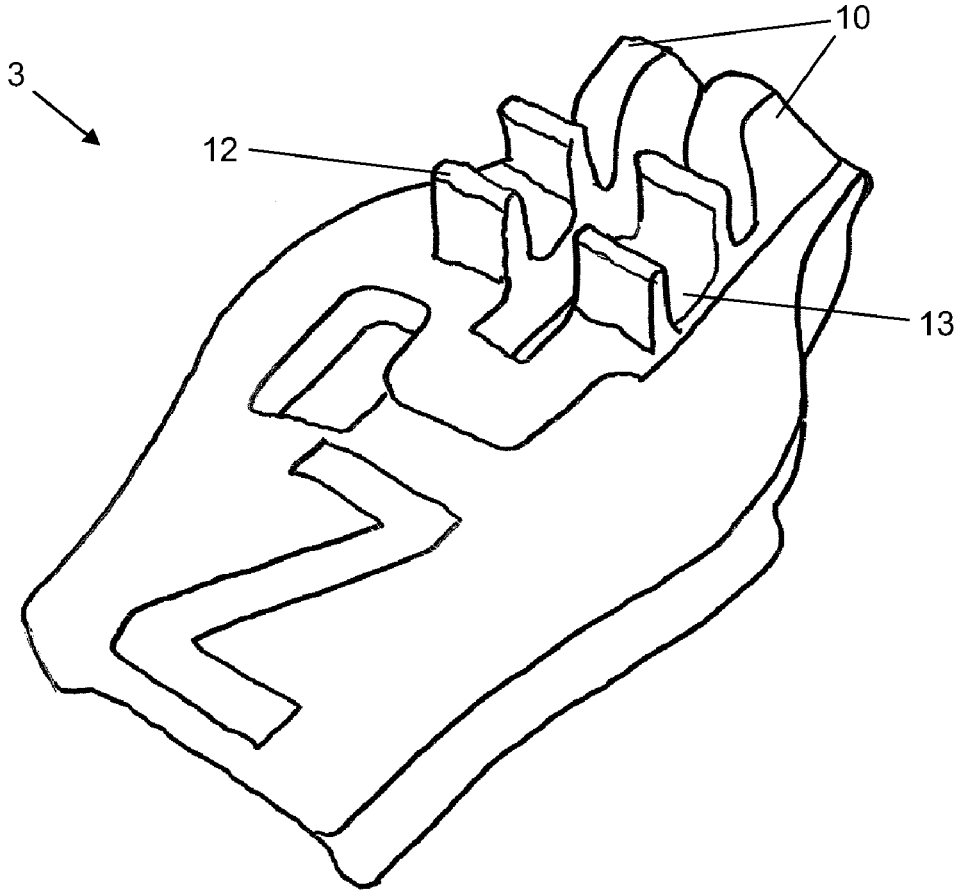
FIG. 4 shows the upper side of the upper part with slanted dividing body and puller cradle.

FIG. 4 shows the upper side of the upper part 3. The upper part can be manufactured from zinc, other alternatives are plastic, steel or brass. Here, the slanted dividing bodies are shown. The dividing shoulders 9 of the puller force the resilient part and the locking pins 6 to an outward movement as the puller is pressed backwards (see FIG. 10). The material 12 is used to form a hinge for the puller. When the upper part and lower part have been interconnected, the locking pins 6 are placed in a cradle 13. The material 12 is punched and bent over the locking pins 6. After this, it is not possible to dismantle the puller and the slider is now assembled (see FIG. 9).

Figure 5:
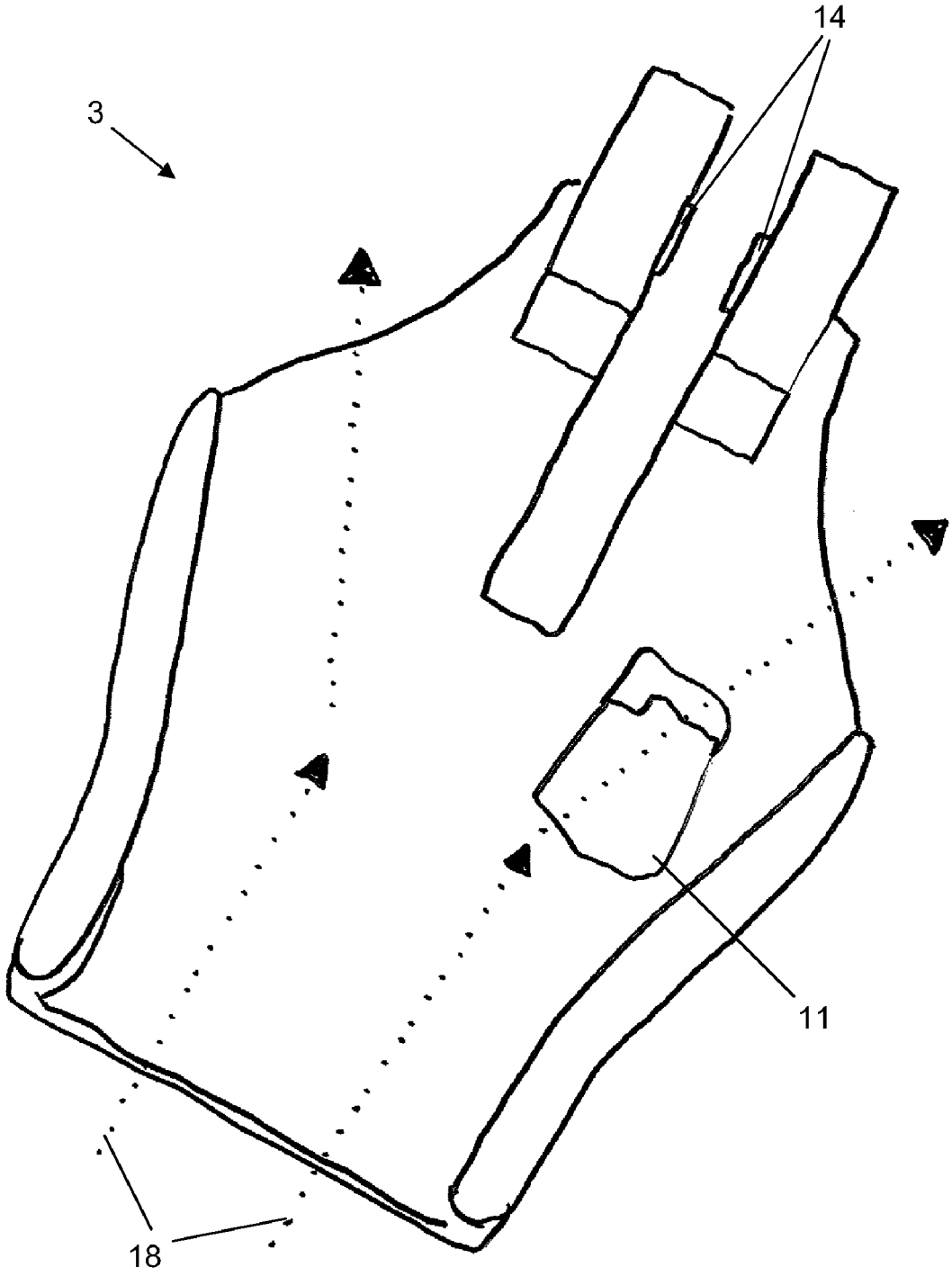
FIG. 5 shows the underside of the upper part with hinge taps and a clearance for the lock tap, and also illustrates the path of the zip fastener.

In FIG. 5, the underside of the upper part 3 is shown. Here, the hinge taps 14 are shown. In order to facilitate assembly of the slider and at the same time form a hinge which makes it possible to open and close the slider, the following functions have been developed. Upon assembly, the hinge taps 14 are led in the guiding groove 15 of the lower part 4 and pressed over the assembly chamfer 16 of the lower part with a certain force, whereby the hinge taps 14 are forced outwards in a slight resilient movement. As the hinge taps have passed said assembly chamfer, the resilient movement returns. The hinge taps are positioned in the hinge site 17 of the lower part 4 and are thereby interconnected with the same and constitute the hinge that renders the slider openable. After formation of this link, it is not possible to disassemble the parts 3, 4. The path 18 of the zip fastener is also illustrated in FIG. 5 as well as a clearance 11 for the lock tap (FIG. 3).

Figure 6:
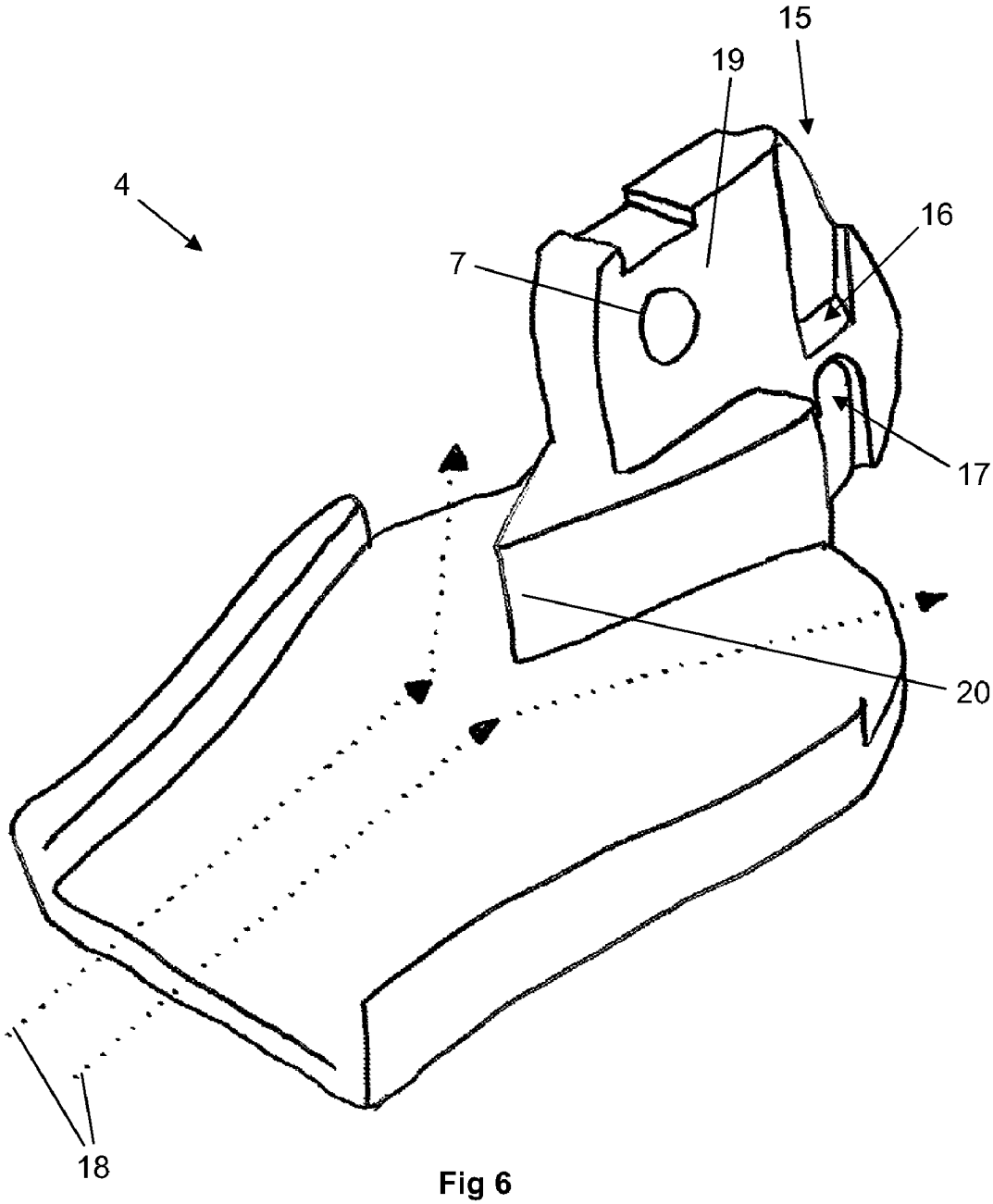
FIG. 6 shows the upper side of the lower part with through hole, bearing surface for locking pins, dividing shoulder for the zip fastener, guiding groove for facilitated assembly (FIG. 8), assembly chamfer and hinge site for hinge taps, and also illustrates the path of the zip fastener.

FIG. 6 shows the upper side of the lower part 4 and illustrates the path 18 of the zip fastener. The lower part can be manufactured from zinc, other alternatives are plastic, steel or brass. The lower part comprises a through hole 7. When the locking pins 6 of the puller 2 are hooked in through hole 7 the slider cannot be opened (FIG. 9). Further, a bearing surface 19 for the locking pins 6 is shown. If the previously described opening function is performed, the locking pins 6 leave their position in the through hole 7 as described below. As the slider 1 is opened (FIG. 10), the locking pins 6 clamp against the bearing surface 19 by means of their spring force. The lower part 4 further comprises a dividing shoulder 20 which opens the zip fastener. When the slider is drawn against the interlinked zip fastener, the teeth of the zip are separated.

In accordance with FIG. 6, the lower part also comprises a guiding groove 15 which facilitates assembly (FIG. 8), an assembly chamfer 16 and a hinge site 17 for the hinge taps 14. In order to facilitate assembly of the slider and at the same time form a hinge which makes it possible to open and close the slider, the following functions have been developed. Upon assembly, the hinge taps 14 of the upper part are led in the guiding groove 15 and pressed over the assembly chamfer 16 with a certain force, whereby the hinge taps 14 are forced outwards in a slight resilient movement. As the hinge taps have passed this chamfer 16, the resilient movement returns and the hinge taps are positioned in the hinge site 17. The linking together of the upper part 3 and the lower part 4 is completed and at the same time the hinge between upper part and lower part is formed. After formation of this link, it is not possible to disassemble the parts 3, 4.

Figure 7:
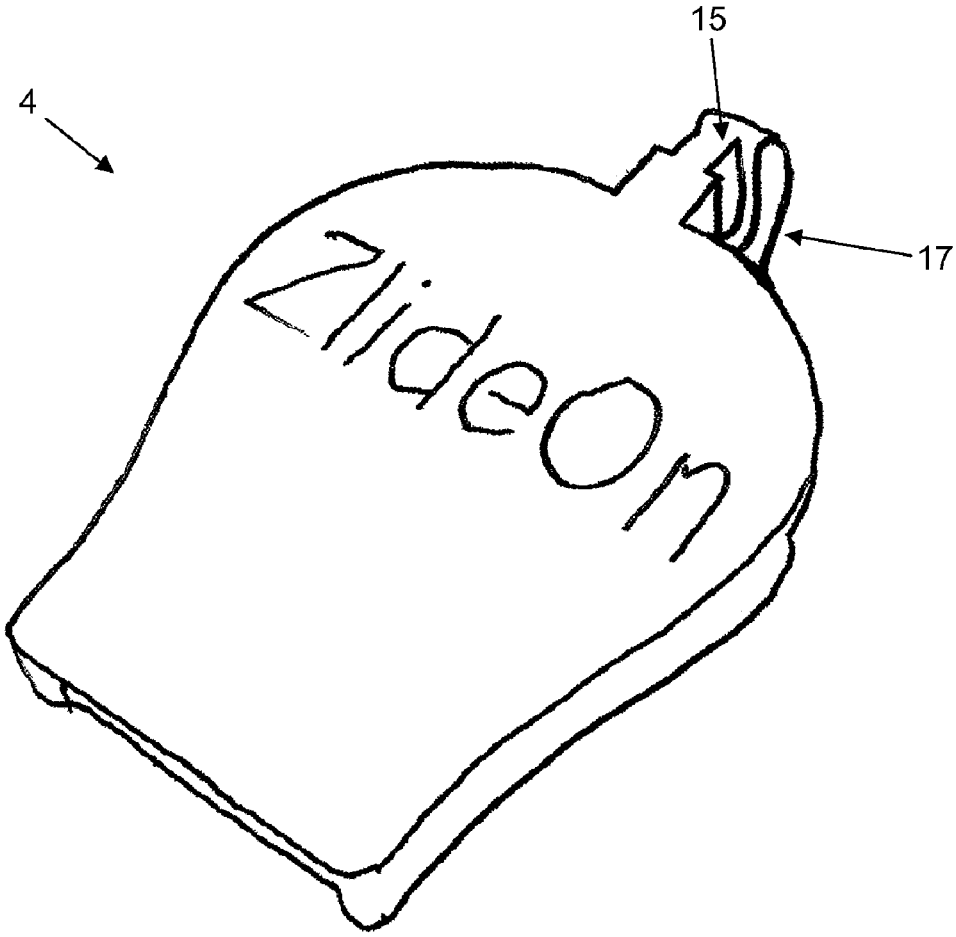
FIG. 7 shows the underside of the lower part with hinge site for hinge taps and guiding groove.

In FIG. 7, the underside of the lower part 4 with the hinge site 17 for the hinge taps 14 is illustrated, and also the guiding groove 15.

Figure 8:
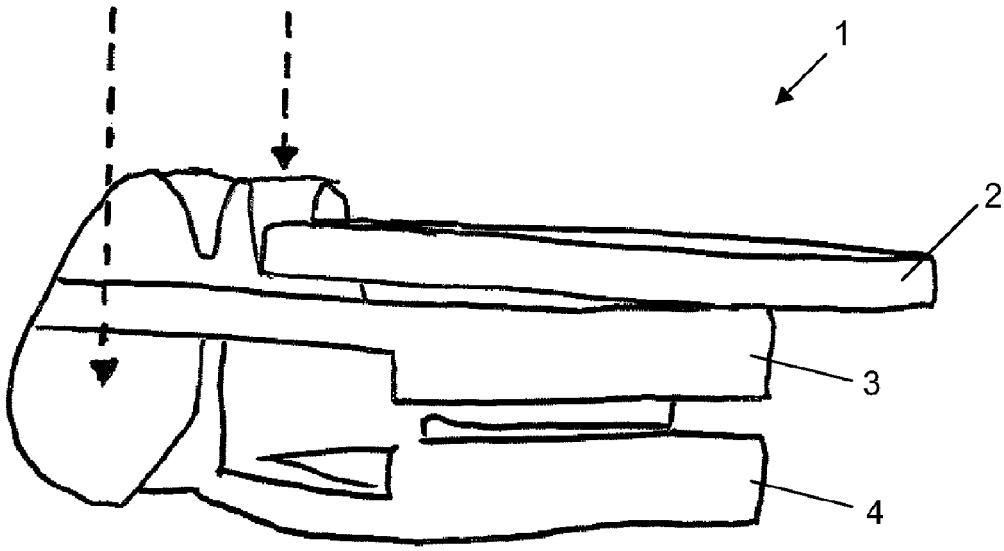
FIG. 8 illustrates the assembly of the puller and the upper part onto the lower part.

FIG. 8 shows how the puller 2 and the upper part 3 are easily mounted to the lower part 4 straight from above.

FIG. 9 shows the slider 1 in the closed condition. The locking pins 6 are located in the through hole 7 of the lower part and in the cradle 13 of the upper part 3. When subsequently material 21 is bent over the locking pins 6, the cradle, which keeps the puller 2 in place, is completed. Mounted on a zip fastener, the function is the same as the function of a conventional slider.

In FIG. 10 is illustrated how the slider 1 is opened. When the puller 2 and its dividing shoulders 9 are brought in a movement backwards and pressed against the dividing bodies 10 of the upper part, the locking pins 6 are forced outwards, and leave the through hole 7 of the lower part 4. This, together with the backward movement 22 applied to the puller 2 opens 23 the slider. The slider can now be mounted or dismounted from a zip fastener.

Figure 11:
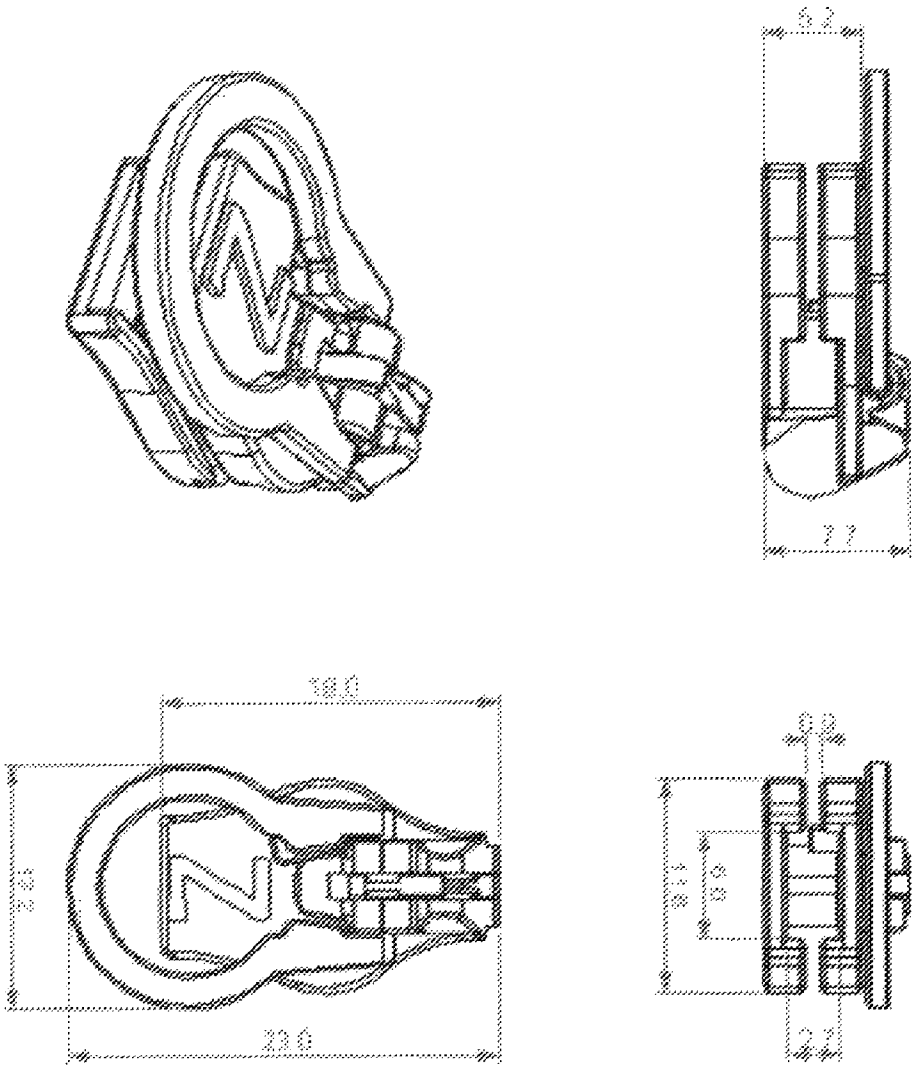
FIG. 11 shows the slider from different angles.

FIG. 11 shows drawings of the slider from various views with dimensions indicated.

The invention claimed is:

1. Slider (1) for a zip fastener, which slider comprises a lower part (4), an upper part (3) and a puller (2), where the lower part (4) and the upper part (3) are interconnected by means of a hinge, whereby the slider can be set in an open and a closed condition, respectively, where the puller (2), which is made of a resilient material and constitutes the part that the user holds when using the slider, comprises locking pins (6) for locking the lower part (4) and the upper part (3) in the closed condition, and also dividing shoulders (9), the lower part (4), which when the slider (1) is mounted to a zip fastener mainly is located on a first side of the zip fastener, comprises a hole (7) which can receive the locking pins (6) of the puller (2) in order to lock the lower part and the upper part in the closed condition, the upper part (3), which when the slider (1) is mounted to a zip fastener mainly is located on a second side of the zip fastener, comprises a cradle (13) for the locking pins (6) of the puller (2) and also a slanted dividing body (10), which can separate the dividing shoulders (9) and therewith the locking pins (6) of the puller (2), and the upper part (3) comprises two hinge taps (14) and the lower part (4) comprises an area (15, 16, 17) for cooperation with said hinge taps, whereby the hinge between the lower part and the upper part is formed through cooperation between the hinge taps (14) and the area (15, 16, 17), characterised in that the area (15, 16, 17) of the lower part comprises an assembly chamfer (16), which by cooperation with the hinge taps (14) is adapted to pivotally lock the upper part (3) and the lower part (4), and in that the area (15, 16, 17) of the lower part also comprises a guiding groove (15), in which the hinge taps (14) are led upon assembly of the upper part (3) to the lower part (4), whereby the assembly chamfer (16) forces the hinge taps (14) outwards in a slight resilient movement.

2. Slider according to claim 1, wherein the area (15, 16, 17) of the lower part further comprises a hinge site (17), in which the hinge taps (14) are positioned after the chamfer (16) has been passed and the resilient movement has returned.

3. Slider according to claim 1, wherein said puller (2) further comprises a lock tap (8) for locking the slider with respect to the zip fastener.

4. Method for assembly of a slider (1) in accordance with claim 1, characterised in that the upper part (3) is mounted to the lower part (4) by pressing the upper part (3) onto the lower part (4) straight from above, whereby the hinge taps (14) of the upper part and the lower parts' area (15, 16, 17) for cooperation with said hinge taps interconnect the parts (3, 4).

5. Slider according to claim 2, wherein said puller (2) further comprises a lock tap (8) for locking the slider with respect to the zip fastener.

* * * * *